US005439869A

United States Patent [19]

Klug et al.

[11] Patent Number: 5,439,869

[45] Date of Patent: Aug. 8, 1995

[54] THERMOREACTIVE RECORDING MATERIAL OF PARTICULAR STABILITY

[75] Inventors: Günter Klug, Monheim; Pieter Ooms, Krefeld; Christian Rasp, Bergisch Gladbach, all of Germany

[73] Assignee: Bayer Aktiengesellschaft, Leverkusen, Germany

[21] Appl. No.: 69,963

[22] Filed: May 28, 1993

[30] Foreign Application Priority Data

Jun. 5, 1992 [DE] Germany ..... 42 18 561.0

[51] Int. Cl.[6] ..... B41M 5/26

[52] U.S. Cl. ..... 503/208; 503/209; 503/210; 503/211; 503/212; 503/216; 503/217; 503/225

[58] Field of Search ..... 427/150–152; 503/200, 208, 209, 210–212, 216, 217, 218, 225

[56] References Cited

U.S. PATENT DOCUMENTS

| | | | |
|---|---|---|---|
| 3,565,848 | 2/1971 | Hiroshima et al. | 260/31.2 |
| 4,134,847 | 1/1979 | Oda et al. | 252/62.1 P |
| 4,749,680 | 6/1988 | Umeda et al. | 503/210 |
| 4,759,797 | 7/1988 | Umeda et al. | 103/30 |
| 4,784,692 | 11/1988 | Umeda et al. | 106/21 |
| 4,806,521 | 2/1989 | Umeda et al. | 503/216 |

FOREIGN PATENT DOCUMENTS

| | | | |
|---|---|---|---|
| 0165041 | 12/1985 | European Pat. Off. | 503/216 |
| 0418399 | 3/1991 | European Pat. Off. | 503/216 |
| 0525535 | 2/1993 | European Pat. Off. | 503/216 |
| 0535788 | 4/1993 | European Pat. Off. | 503/216 |
| 58-005288 | 1/1983 | Japan | 503/216 |
| 59-209192 | 11/1984 | Japan | 503/216 |
| 2210702 | 6/1989 | United Kingdom | 503/216 |

*Primary Examiner*—B. Hamilton Hess
*Attorney, Agent, or Firm*—William C. Gerstenzang; Sprung Horn Kramer & Woods

[57] ABSTRACT

New thermoreactive recording materials contain a mixture containing at least one specifically modified bisphenol carboxylic acid and at least one basic compound. They are distinguished by good stabilization of the color even upon extended storage, good light stabilities and excellent stabilities to water, plasticizers, greases and ingredients of text-marking pens.

11 Claims, No Drawings

THERMOREACTIVE RECORDING MATERIAL OF PARTICULAR STABILITY

The present invention relates to a thermoreactive recording material containing a base material, dyestuff-forming compounds, additives and, if appropriate, acid developers.

It is known to produce thermoreactive recording materials by first preparing the following aqueous dispersions:

a) a dispersion containing at least one colourless or weakly coloured dyestuff-forming compound, b) a dispersion containing at least one acid developer and, if appropriate, c) a dispersion containing at least one sensitiser and, if appropriate, further additives, mixing these dispersions, applying the mixture of dispersions to a base material, for example to paper or a plastic sheet, followed by drying.

If desired, dispersions b) and c) can be prepared as a joint dispersion. Nor is it necessary to mix these individual dispersions, it also being possible for them to be applied to a base material one after the other.

The base material can be used as such or in pretreated, for example precoated, form. Such a precoating can condition the base material in any desired manner, for example with respect to smoothness, absorbency and/or reflectivity.

In the thermoreactive layer, images or information are produced via colour formation with the aid of thermal energy, for example by means of a thermal head. Such systems are described, inter alia, in JP-A2-57/191,089, JP-A2-58/205,793, JP-A2-58/205,795, JP-A2-58/209,592, JP-A2-58/211,494, JP-A2-58/098,285, JP-A2-58/289,591, JP-A2-58/211,493 and JP-A2-59/9,092, and in German Offenlegungsschrift 3,242,262, EP-A 173,232 and U.S. Pat. No. 4,713,364.

Such heat-sensitive recording materials can be used, for example, as thermal papers in printers of computers, in ticket machines, in label-printing machines, in recorders of, for example, medical measuring instruments and in telefax machines.

A great disadvantage of the known heat-sensitive recording materials is the lack in stability of the images produced to greases and plasticisers.

Stability to such influences is of particular importance in the case of food labels, storage of medical information and information received via a telefax machine. For example, upon contact with greases or plasticisers, such as may be present in plastic envelopes in which their corresponding printouts are sorted and stored, the images and information in the thermosensitive layer fade or disappear almost completely with time. It is true that the fading or disappearance of the images and information can be delayed or prevented by coating the thermosensitive layer with certain materials (see, for example, German Offenlegungsschrift 3,828,731 and GB-A 2,122,363), but this surface coating reduces the sensitivity of the thermosensitive recording material to such an extent that it can no longer be used or only be used with a high loss in intensity of the images and information in the high-speed telefax machines, which require thermal papers of higher sensitivity. Moreover, an additional coating process is a cost-intensive procedure.

JP-A2-58/005,288, JP-A2-59/209,192 and JP-A2-57/045,093 describe bisphenol carboxylic acids and esters thereof as developers, which are said to contribute to improving the grease and plasticiser stability of thermosensitive recording material. However, the effect is either weak or associated with insufficient storage stability, resulting in extensive greying of the otherwise mostly white thermosensitive recording materials.

U.S. Pat. No. 3,565,848 describes salts of modified bisphenol carboxylic acids, which serve to improve the stability of phenolic resins used in moulding compositions, casting moulds and abrasive materials (for example grinding stones). EP-A 0,218,810, EP-A 0,271,081 and German Offenlegungsschrift 2,724,107 describe the use of metal salts of substituted salicylic acids in recording materials. Their disadvantage is that when used in thermosensitive layers they exhibit insufficient whiteness in combination with very poor storage stability.

Accordingly, there is a need for a heat-sensitive recording material having high thermal sensitivity and good stability to greases and plasticisers in combination with high whiteness and good storage stability.

Thermoreactive recording materials have now been found which are characterised in that they contain a mixture containing at least one modified bisphenol carboxylic acid of the formula (I)

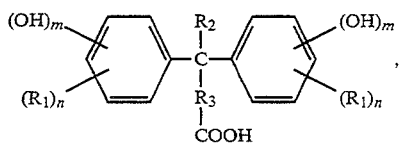

(I)

in which each $R_1$, independently of the others, represents $C_1$- to $C_5$-alkoxy, $C_1$- to $C_6$-alkyl, $C_3$- to $C_6$-cycloalkyl or phenyl, $R_2$ represents hydrogen, $C_1$- to $C_6$-alkyl or phenyl, $R_3$ represents $C_1$- to $C_5$-alkylene or a direct bond, each m, independently of the other, represents one or two, and each n, independently of the other, represents zero, one or two, and at least one basic compound.

Examples of compounds of the formula (I) are those in which each $R_1$, independently of the others, represents ethoxy, methoxy, i-propoxy, butoxy, pentoxy, methyl, ethyl, propyl, butyl, i-propyl, pentyl, cyclopropyl, cyclobutyl, cyclopentyl, cyclohexyl or phenyl, $R_2$ represents hydrogen, methyl, ethyl, propyl, butyl, 2-propyl, 1-pentyl, 2-pentyl, 1-hexyl, i-butyl or phenyl, $R_3$ represents methylene, 1,1-ethylene, 1,2-ethylene, 1,1-propylene, 1,2-propylene, 1,3-propylene, 2,2-propylene, 1,1-butylene, 1,2-butylene, 1,3-butylene, 1,4-butylene, 2,2-butylene, 2,3-butylene or a direct bond, and m and n have the abovementioned meaning.

Preference is given to compounds of the formula (I) in which each $R_1$, independently of the others, represents ethoxy, methoxy, i-propoxy, butoxy, pentoxy, methyl, ethyl, propyl, butyl, i-propyl, pentyl, cyclopropyl, cyclopentyl, cyclohexyl or phenyl, $R_2$ represents hydrogen, methyl, ethyl, propyl, butyl, 2-propyl, pentyl, hexyl, i-butyl or phenyl, $R_3$ represents methylene, 1,1-ethylene, 1,2-ethylene, 1,1-propylene, 1,2-propylene, 1,3-propylene, 1,1-butylene, 1,2-butylene, 1,3-butylene, 1,4-butylene, 2,2-butylene, 2,3-butylene or a direct bond, and m and n have the abovementioned meanings.

The basic compounds can, for example, be compounds of polyvalent metals, such as hydroxides, oxides and/or carbonates of magnesium, zinc, calcium, aluminium, lead, boron and/or titanium.

It is possible to use a single basic compound or to use two or more basic compounds together.

Particular preference is given to mixtures of bisphenol carboxylic acids of the formula (I) in which each $R_1$, independently of the others, represents ethoxy, methoxy, i-propoxy, butoxy, methyl, ethyl, propyl, butyl, i-propyl, pentyl, cyclopentyl, cyclohexyl or phenyl, $R_2$ represents hydrogen, methyl, ethyl, propyl, butyl, 2-propyl, pentyl, hexyl, or phenyl, $R_3$ represents methylene, 1,1-ethylene, 1,2-ethylene, 1,1-propylene, 1,2-propylene, 1,3-propylene, 1,1-butylene, 1,2-butylene, 1,3-butylene, 1,4-butylene, 2,2-butylene or a direct bond, m represents one, and n has the abovementioned meaning, with oxides, hydroxides and/or carbonates of $Mg^{2+}$, $Zn^{2+}$, $Ca^{2+}$, $Al^{3+}$, $B^{3+}$ and/or $Ti^{4+}$.

Preference is given to mixtures of modified bisphenol carboxylic acids of the formula (I) having a symmetrical structure, i.e. those compounds of the formula (I) in which both radicals $R_1$ are identical, both numbers m are identical, both numbers n are identical and the OH and $R_1$ groups on both aromatic rings are in the same positions, with oxides, hydroxides and/or carbonates of $Mg^{2+}$, $Zn^{2+}$ and/or $Ca^{2+}$.

Furthermore, preference is given to mixtures containing, as compounds of the formula (I), those in which $R_1$ represents hydrogen, methyl or tert.-butyl, $R_2$ represents hydrogen or methyl, $R_3$ represent $C_1$- to $C_3$-alkylene or a direct bond, m represents one, and n represents zero or one.

For recording materials according to the invention, preference is also given to mixtures containing, as modified bisphenol carboxylic acids of the formula (I), those in which the OH groups are either in the para or in the ortho and para position relative to the $R_2$—C—$R_3$—COOH grouping and the $R_1$ group(s) is(are) in the meta and/or ortho position relative to the $R_2$—C—$R_3$—COOH grouping. Particularly preferably, OH is in the para and $R_1$ in the meta position relative to the $R_2$—C—$R_3$—COOH grouping.

Bisphenol carboxylic acids of the formula (I) can be prepared by processes known per se by condensation of the corresponding phenol of the formula (II)

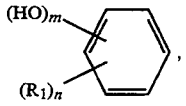

(II)

in which $R_1$, m and n have the meaning given in formula (I), with the corresponding oxocarboxylic acid of the formula (III)

$$R_2-\underset{\underset{O}{\|}}{C}-R_3-COOH, \qquad (III)$$

in which $R_2$ and $R_3$ have the meaning given in formula (I), (see, for example, J. Org. Chem. 23, 1005 (1958); J. Org. Chem. 24, 1949 (1951); J. Org. Chem. 27, 455 (1962) and JACS 76, 4465 (1954)).

The mixtures of the modified bisphenol carboxylic acids of the formula (I) with the basic compounds can be obtained from the components, for example, by vigorous mixing in commercially available mixing devices (for example Starmix ® or corundum disc mills) or, for example, by direct preparation of a dispersion containing these components. Such a dispersion can be prepared, for example, by stirring one or more bisphenol carboxylic acids of the formula (I) and one or more basic compounds simultaneously or in succession into customary aqueous solutions containing dispersing aids.

In the mixtures, the molar ratio of modified bisphenol carboxylic acids of the formula (I) to basic compounds can be, for example, 0.05 to 5:1. It is preferably 0.15 to 3:1, particularly preferably 0.2 to 2:1.

Thermoreactive recording materials according to the invention can contain any desired leuco dyestuffs customary as colour formers. Preference is given to leuco dyestuffs of the triphenylmethane, fluoran, phenothiazine, auramine, spiropyran and indolinophthalide type, each of which can be used by itself or in combination.

Examples of such colour formers are: 3,3-bis-(p-dimethylamminophenyl)-6-dimethylaminophthalide (=crystal violet lactone), 3,3-bis-(p-dimethylaminophenyl)-6-chlorophthalide, 3-cyclohexylamino-6-chlorofluoran, 3-dimethylamino-5,7-dimethylfluoran, 3-diethylamino-7-methylfluoran, 3-(N-p-tolyl-N-ethylamino)-6-methyl-7-anilinofluoran, 2-[3,6-bis-(diethylamino)-9-(o-chloroanilino)-xanthyl]benzolactam, 3-N-methyl-N-cyclohexylamino-6-methyl-7-anilinofluoran, 3-diethylamino-6-methyl-7-anilinofluoran, 3-(N,N-diethylamino)-5-methyl-7-(N,N-dibenzylamino)-fluoran, 6'-chloro-8'-methoxy-benzoindolino-spiropyran, 3-(2'-hydroxy-4'-dimethylaminophenyl)-3-(2'-methoxy-5'-nitrophenyl)-phthalide, 3-(2'-methoxy-4'-dimethylaminophenyl)-3-(2'-hydroxy-4'-chloro-5'-methylphenyl)phthalide, 3-(N-ethyl-N-tetrahydrofurfuryl)-amino-6-methyl-7-anilinofluoran, 3-N-ethyl-N-(2-ethoxypropyl)amino-6-methyl-7-anilinofluoran, 3-(N-methyl-N-isopropyl)-amino-6-methyl-7-anilinofluoran, 3-morpholino-7-(N-propyl-trifluoromethylanilino)-fluoran, 3-diethylamino-5-chloro-7-(N-benzyl-trifluoromethylanilino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-piperidinofluoran, 3-dibutylamino-6-methyl-7-anilinofluoran, 3,6-bis-(dimethylamino)-fluoren-9-spiro-3'-(6'-dimethylamino)-naphthalide, 3-(N-benzyl-N-cyclohexylamino)-5,6-benzo-7-naphthylamino-4'-bromofluoran, 3-diethylamino-6-chloro-7-anilinofluoran, 3-N-methyl-N-isopropyl-6-methyl-7-anilinofluoran, 3-N-ethyl-N-amyl-6-methyl-7-anilinofluoran and 3-diethylamino-6-methyl-7-(2',4'-dimethylanilino)fluoran.

Thermoreactive recording materials according to the invention can contain, as colour developers,any desired customary electron acceptors which, upon application of heat, induce colour formation by the leuco dyestuffs. Compounds which are suitable for this purpose are, for example, polyphenols, hydroxydiphenyl sulphones, hydroxydiphenyl sulphoxides, hydroxybenzoic esters, esters of bile acids, hydroxydiphenyl sulphides, hydroxydiphenyl disulphides, salicylic acids, esters or amides thereof, hydroxynaphthalenic acids, esters or amides thereof, bis-(hydroxyphenylthio)-dioxaalkanes, bis-(hydroxyphenylthio)-oxaalkanes, bis-(hydroxyphenyl)-alkanes and bis-(hydroxyphenyl)-alkanoic esters.

Individual examples of such colour developers are: 4,4'-isopropylidenebisphenol, 4,4'-isopropylidenebis(o-methylphenol), 4,4'-sec.-butylidenebisphenol, 4,4'-isopropylidenebis(2-tert.-butylphenol), 4,4'-cyclohexylidenediphenol, 4,4'-isopropylidenebis(2-chlorophenol), 2,2'-methylenebis(4-methyl-6-tert.-butylphenol), 2,2'-methylenebis(4-ethyl-6-tert.-butylphenol), 4,4'-butylidenebis(6-tert.-butyl-2-methyl)-phenol, 1,1,3-tris(2-methyl-4-hydroxy-5-tert.-butylphenyl)butane, 4,4'-thiobis(6-tert.-butyl-2-methyl)phenol, bis(p-hydroxyphenyl) sulphone, 4-isopropoxy-4'-hydroxydiphenyl sulphone, 4-benzyloxy-4'-hydroxydiphenyl sulphone, bis(p-hydroxyphenyl) sulphoxide, isopropyl p-hydroxybenzoate, benzyl p-hydroxybenzoate, stearyl gallate, lauryl gallate, octyl gallate, 1,7-bis(4-hydroxyphenylthio)-3,5-dioxaheptane, 1,5-bis(4-hydroxyphenylthio)-3-oxapentane, 1,3-bis(4-hydroxyphenylthio)-propane, 1,3-bis(4-hydroxyphenylthio)-2-hydroxypropane, N,N'-diphenylthiourea, N,N'-di(m-chlorophenyl)-thiourea, salicylanilide, 5-chloro-salicylanilide, 2-hydroxy-3-naphthoic acid, 2-hydroxy-1-naphthoic acid, 1-hydroxy-2-napthoic acid, bis(4-hydroxyphenyl)-benzyl acetate, 3,4-dihydroxyphenyl 4'-methylphenyl sulphone, 1,7-bis-(4-hydroxyphenylthio)-3-dioxaheptane, 1,5-bis-(4-hydroxyphenylthio)-3-oxapentane, 1,4-bis-(4-hydroxyphenylthio)-butane and methyl 2,2-bis-(4-hydroxyphenyl)-acetate.

Preferably, but not necessarily, thermoreactive recording materials according to the invention additionally contain, apart from colour formers, colour developers, modified bisphenol carboxylic acids and basic compounds, so-called sensitisers. These can be customary heat-meltable substances which are capable of increasing the colour developing rate and/or enhancing colour formation. Such sensitisers can, for example, have a melting point in the range from 70° to 140° C., preferably 70° to 130° C. and in particular 75° to 120° C., and be, for example, from the following classes of compounds: aromatic sulphonamides, carboxamides, anilides, p-hydroxybenzoic esters, oxalic diesters, diphenyl sulphones, benzyldiphenyls, terphenyls, phenyl salicylates, terephthalic diesters, isophthalic diesters and waxes (see also JP-A2-57/191,089, JP-A2-58/98,285, JP-A2-58/205,793, JP-A2-58/205,795, JP-A2-58/209,591, JP-A2-58/209,592, JP-A2-58/211,493, JP-A2-58/211,494 and JP-A2-59/9,092.

Examples of sensitisers are: stearamide, benzenesulfonanilide, p-benzylbiphenyl, dibenzyl oxalate, dimethyl terephthalate, 1- and 2-benzyloxynaphthalene, ethylene glycol m-tolyl ether, diphenyl carbonate, dibenzyl terephthalate, dibenzyl isophthalate, m-terphenyl, 1,2-diphenoxyethane, benzyl p-hydroxybenzoate and bis-[2-(4-methoxyphenyloxy)-ethyl]ether.

If desired, thermoreactive recording materials according to the invention can additionally contain binders and/or other customary additives. The binders can be, for example, partially or completely hydrolysed polyvinyl acetate, hydroxyethylcellulose, gum arabic, starch, polyvinylpyrrolidone or casein, and the remaining additives can be, for example, fillers, surface-active agents, antioxidants and/or antifoams.

Examples of suitable fillers are fine powders of inorganic compounds, such as calcium compounds, silica, titanium oxide, barium sulphate, talc and surface-treated silica, and fine powders of organic compounds, such as urea, formaldehyde resins, styrene/methacrylic acid copolymers, polystyrene resins and polyacrylic copolymers (see, for example, German Offenlegungsschrift 3,715,724).

Thermoreactive recording materials according to the invention can contain a wide range of base materials. For example, any desired type of paper, which can be used in untreated or pretreated form, is suitable. Preference is given to papers such as commonly used for producing copies on telefax machines, labels and tickets, for labelling freight articles and luggage items, for scientific and medical data recording and for similar purposes. The pretreated papers can be, for example, precoated papers, in which case the purpose of the coating can be, for example, to apply fillers and/or to influence the heat conductivity. Such pretreatments can have been carried out on one or both sides of the paper. The paper can also have been calendered or smoothed in the paper machine on one or both sides. One side of the paper, preferably the back, can, if desired, also have been provided with a plastic material, gelatin, an adhesive and/or a release layer. Examples of papers which are suitable for thermoreactive recording materials according to the invention are those having a basis weight of 20 to 200 g/m$^2$, preferably 30 to 100 g/m$^2$. The base materials used for thermoreactive recording materials according to the invention can also be any desired type of sheets. Preference is given to those sheets which are usually used as base materials for overhead projection or other presentation systems. Furthermore, the base material used can also be paperboard and cardboard, which, if desired, can have been coated and/or pretreated as described for paper as the base material.

In the coating (i.e. disregarding the base material), thermoreactive recording materials according to the invention can contain, for example, 0.1 to 40% by weight of the mixture of modified bisphenol carboxylic acids of the formula (I) and basic compounds. This amount is preferably 1 to 30% by weight, particularly preferably 5 to 25% by weight. The coating can additionally contain, for example, 1 to 20% by weight of colour formers. The amount of colour former is preferably 2 to 15% by weight, particularly preferably 5 to 10% by weight. Furthermore, the coating can contain, for example, 0 to 30% by weight of colour developer. Preferably, these amounts are 5 to 25% by weight, in particular 10 to 20% by weight. Furthermore, the coating can contain sensitisers, for example in an amount of 0 to 30% by weight, preferably 5 to 25% by weight, in particular 10 to 20% by weight. Binders and customary additives can be present in the coating, for example in an amount of 5 to 80% by weight, the preferred amount being 20 to 70% by weight, in particular 30 to 60% by weight. The sum of all coating components adds up to 100% by weight.

Themoreactive recording materials according to the invention can be prepared, for example, by first preparing starting dispersions, that is a colour former dispersion, a dispersion containing the mixture of a modified bisphenol carboxylic acid of the formula (I) with the basic compound and a developer dispersion. The starting dispersions can be mixed and then applied to a base material, for example to a plastic sheet or paper, using a suitable device, for example a doctor knife.

Binders and other additives can be added, if desired, to one, more or all of the starting dispersions or to the mixture of these dispersions. The procedure can also be such that individual starting dispersions or any desired different mixtures of starting dispersions are applied to a base material in succession.

The application of individual or all dispersions is followed by drying.

Thermoreactive recording materials according to the invention are preferably prepared as follows (parts are parts by weight):

a. Preparation of a colour former dispersion 5 to 95 parts of one or more colour formers, preferably 20 to 75 parts, particularly preferably 30 to 50 parts, are stirred into 272 parts of an aqueous polyvinyl acetate solution consisting of 0.1 to 30 parts, preferably 1 to 20 parts, particularly preferably 2 to 15 parts, of partially hydrolysed polyvinyl acetate and 90 parts of water, and the mixture is milled (for example using a sand mill) until the average particle size of the colour former particles is 3 μm or less.

b. Preparation of a developer dispersion 1 to 50 parts of one or more colour developers, preferably 5 to 30 parts, particularly preferably 10 to 20 parts, and 10 to 100 parts of one or more sensitisers, preferably 20 to 80 parts, particularly preferably 35 to 60 parts, and 1 to 20 parts of one or more antioxidants, preferably 3 to 5 parts, particularly preferably 5 to 10 parts, are stirred into 250 parts of an aqueous polyvinyl acetate solution consisting of 0.1 to 30 parts, preferably 1 to 20 parts, particularly preferably 2 to 15 parts, of partially hydrolysed polyvinyl acetate and 90 parts of water, and the mixture is milled (for example using a sand mill) until the average particle size of all the solid particles is 3 μm or less.

c. Preparation of a dispersion containing a mixture of modified bisphenol carboxylic acid and basic compound 1 to 50 parts of at least one modified bisphenol carboxylic acid of the formula (I), preferably 3 to 35 parts, particularly preferably 5 to 30 parts, and 1 to 30 parts of at least one oxide, hydroxide and/or carbonate of at least one polyvalent metal, preferably 3 to 25 parts, particularly preferably 5 to 20 parts, are mixed (for example in a mixer). 5 to 50 parts of this mixture, preferably 10 to 45 parts, particularly preferably 20 to 35 parts, are stirred into 70 parts of an aqueous polyvinyl acetate solution consisting of 0.1 to 30 parts, preferably 1 to 20 parts, particularly preferably 1.5 to 15 parts, of partially hydrolysed polyvinyl acetate and 66 parts of water, and the mixture is milled (for example in a sand mill) until the average particle size is 3 μm or less.

d. Preparation of a filler dispersion 10 to 100 parts of one or more fillers, preferably 15 to 70 parts, particularly preferably 20 to 50 parts, are stirred into 70 parts of water, and the mixture is milled (for example in a sand mill) until the average particle size is 3 μm or less.

e. Preparation of a binder solution 1 to 50 parts of one or more binders (for example polyvinyl acetate), preferably 5 to 30 parts, particularly preferably 10 to 20 parts, are dissolved in 90 parts of water.

f. Preparation of a coating paint 120 to 40 parts, preferably 100 to 50 parts, particularly preferably 80 to 60 parts, of dispersion b. are stirred together with 30 to 0.5 part, preferably 25 to 3 parts, particularly preferably 20 to 5 parts of dispersion a., 40 to 0.5 part, preferably 30 to 5 parts, particularly preferably 20 to 10 parts, of dispersion c., 60 to 5 parts, preferably 50 to 10 parts, particularly preferably 40 to 20 parts, of dispersion d. and 40 to 0.5 parts, preferably 30 to 5 parts, particularly preferably 20 to 10 parts, of dispersion e., and the mixture is brought to a pH of 6 to 14, preferably 7 to 11, particularly preferably 7.5 to 9.5, with dilute base.

g. Production of a thermoreactive recording material according to the invention

The coating paint is knife-coated onto a paper surface in an amount corresponding to a coating weight of 2 to 15 g/m$^2$, preferably 5 to 12 g/m$^2$, particularly preferably 7.5 to 10.5 g/m$^2$.

After drying, the coated paper is preferably calendered.

Thermoreactive recording materials according to the invention and not according to the invention were evaluated in the examples below by the following measuring methods:

a. Optical density

In a thermoprinter (Sharp CE 700 P), an area of 4×0.9 cm was printed fully in black at maximum energy. The optical density of this measuring area was determined using a Macbeth Densitometer RD 917 (Kollmorgen AG, Switzerland).

b. Grease stability

First, the optical density was determined according to a. A 20% strength by weight solution of castor oil in cyclohexane was then impressed onto the printed area using a gravure printing machine (well depth 150#, Gockel, Germany). After storing the printed paper at 60° C. for 3 hours, the optical density was again measured (analogously to a.), and the remaining intensity in per cent was calculated as follows:

$$\text{\% of remaining intensity} = \frac{\text{optical density with grease} \times 100\%}{\text{optical density without grease}}$$

c. Plasticiser stability

The plasticiser stability was determined by first printing an area of 4×4 cm in black in a thermoprinter (Sharp CE 700 P) at maximum energy and different line density in the printing area.

The absorption of this area was determined by means of an Elrepho 44 381 (Carl Zeiss, Germany). The back of the printed area was placed on a steel plate, the printed area was covered with a PVC sheet containing 30% by weight of plasticiser (dioctyl phthalate) and weighted with a steel block of dimensions 4×3×2.5 cm. This corresponded to a pressure of 20 g/cm$^2$.

After 24 hours of storage at 50° C., the absorption of the printed area was again determined, and the remaining intensity in per cent was calculated as follows:

$$\text{\% of absorption} = 100 \times \frac{\text{\% of reflectance measured on the unprinted paper} - \text{\% of reflectance measured on the printed paper}}{\text{\% of reflectance measured on the unprinted paper}}$$

-continued $$\% \text{ of remaining intensity} = \frac{\text{\% of absorption after contact with sheet} \times 100}{\text{\% of absorption before contact with sheet}}$$

d. Whiteness and storage stability

Whiteness was determined as % reflectance (a large value corresponds to high whiteness), and the undesirable discolouration of the unprinted paper after storage at 60° C. was calculated from the reflectance (carried out as described under c.) as % of absorption (a large value corresponds to dark paper).

e. Sensitivity

The sensitivity was determined by printing in each case an area of 5.5×0.8 cm fully in black in a thermoprinter test apparatus TP 104 (Geminus, Germany) at a head voltage of 26 V and variable heating periods. The optical density of these areas was determined using a Macbeth Densitometer RD 917. A thermopaper is all the more sensitive, the larger the differences in optical densities are at short and longer heating periods.

The mixtures of modified bisphenol carboxylic acids with basic compounds to be used according to the invention are also suitable as developers and/or additives in carbonless copying systems.

Recording materials according to the invention simultaneously exhibit stabilisation of the colour even at extended storage, good light stabilities and excellent stabilities to water, plasticisers, greases and ingredients of text-marking pens, while, at the same time, a high whiteness of the. paper is maintained even at extended storage and/or at elevated temperature.

EXAMPLES

Below, parts and percentages are by weight and amounts are amounts by weight.

EXAMPLE 1

Preparation of a dispersion to be used according to the invention from 4,4-bis-(4-hydroxyphenyl)-pentanoic acid and magnesium hydroxide 572.7 g of 4,4-bis-(4-hydroxyphenyl)-pentanoic acid were milled together with 58.3 g of magnesium hydroxide. 30 g of this mixture were stirred into 70 g of a 4% strength polyvinyl acetate solution (prepared from Mowiol ® 8/88). The coarse dispersion was then milled together with 400 g of glass beads (diameter 1 mm) in a sand mill until an average particle size of 2.5 μm was reached (→dispersion 1).

EXAMPLE 2

Preparation of a dispersion to be used according to the invention from 2,2-bis-(4-hydroxyphenyl)-ethanoic acid and zinc oxide 25.7 g of 2,2-bis-(4-hydroxyphenyl)-ethanoic acid and 4.3 g of zinc oxide were stirred into 70 g of a 4% strength polyvinyl acetate solution (prepared from Mowiol ® 8/88), and the mixture was milled in a sand mill as described in Example 1.

EXAMPLE 3

Production of a recording material without a modified bisphenyl carboxylic acid of the formula (I) and without a basic compound—not according to the invention.

10 g of polyvinyl acetate (V 03140 type from Wacker Chemie) were dissolved in 605 g of water. 50 g of methyl 2,2-bis-(4-hydroxyphenyl)-ethanoate, 60 g of dimethylterephthalate, 30 g of zinc stearate, 30 g of p-benzylbiphenyl and 15 g of a commercially available antioxidant (sterically hindered phenol) were stirred into this solution. The coarse dispersion was then milled together with 1250 g of glass beads (diameter 1 mm) in a sand mill until the average particle size was 2.5 μm (→dispersion 2).

4 g of polyvinyl acetate (V 03/140 type from Wacker Chemie) were dissolved in 68 g of water. 8 g of 2-anilino-3-methyl-6-dibutylaminofluoran and 4 g of stearylamide were stirred into this solution, and the mixture was milled in a sand mill as described above until the average particle size was 2.8 μm (→dispersion 3).

10 g of a 30% strength calcium carbonate dispersion in water (average particle size less than 3 μm), 4 g of a 10% strength polyvinyl acetate solution (M 05/20 type from Wacker Chemie) in water, 16 g of dispersion 2 and 4 g of dispersion 3 were mixed together, the pH of the mixture was brought to 9 with 10% strength aqueous sodium hydroxide solution, and the surface of a base paper having a basis weight of 70 g/m$^2$ was coated by means of a doctor blade. After drying, the coating weight was 8.9 g/m$^2$. The rough paper thus obtained was smoothed in a calender at a line pressure of 80 kg/cm. The measured results obtained in the evaluation of the paper thus coated are listed in Table 1.

EXAMPLE 4

Production of a recording material according to the invention

A coating composition containing calcium carbonate, polyvinyl acetate, water, dispersions 2 and 3 and methyl 2,2-bis-(4-hydroxyphenyl)-ethanoate as developer was prepared as described in Example 3. 34 g of this mixture and 5.2 g of dispersion 1 obtained according to Example 1 were mixed, the pH of the mixture was brought to 9 with 10% strength aqueous sodium hydroxide solution and used to coat the surface of a base paper having a basis weight of 70 g/m$^2$ by means of a doctor blade. The coating weight was 9.8 g/m$^2$. Smoothing was carried out analogously to Example 3.

The measured results obtained in the evaluation of the paper thus coated are listed in Table 1.

EXAMPLE 5

Production of a recording material without a mixture of bisphenol carboxylic acid and basic compound—not according to the invention Example 3 was repeated. Before smoothing the coated paper, a second coating was applied using a mixture of 100 parts of 10% strength by weight polyvinyl acetate solution (prepared from Mowiol ® 4/98), 20 parts of calcium carbonate, 10 parts of a polyethylene wax emulsion (Luba-print ® 499, L. P. Bader & Co. GmbH Chem. Fabrik, Rottweil, Germany) and 55 parts of water.

The coating weight of the second layer was 6 g/m$^2$. Finally, the paper was smoothed analogously to Example 3.

The measured results obtained in the evaluation of the paper thus coated are listed in Table 2.

EXAMPLE 6

Production of a recording material using bisphenol carboxylic acid—not according to the invention The procedure of Example 4 was repeated, using the corresponding amount of bisphenolcarboxylic acid (instead of the mixture of bisphenolcarboxylic acid and magnesium hydroxide) for preparing dispersion 1.

The measured results obtained in the evaluation of the paper thus coated are listed in Table 1.

EXAMPLE 7

Production of a recording material using a salt of salicylic acid—not according to the invention The procedure of Example 4 was repeated, except that the dispersion obtained from 30 g of the zinc salt of 3-methylsalicylic acid and 70 g of a 10% strength aqueous polyvinyl acetate solution (prepared from Mowiol ® 8/88) was used instead of dispersion 1 used there.

The measured results obtained in the evaluation of the paper thus coated are listed in Table 1.

EXAMPLE 8

Production of a recording material using an ester of a bisphenolcarboxylic acid—not according to the invention The procedure of Example 6 was repeated, using the corresponding amount of methyl 4,4-bis-(4-hydroxyphenyl)pentanoate instead of bisphenol carboxylic acid.

of 2,2-bis-(4-hydroxyphenyl)-propane, 60 g of p-benzylbiphenyl, 30 g of zinc stearate and 15 g of 1,1-bis-(3-tert.-butyl-4-hydroxy-6-methylphenyl)-butane were stirred into this solution, and the mixture was milled in a sand mill in the same manner as dispersion 2 in Example 3 (→dispersion 4).

286.3 g of 4,4-bis-(4-hydroxyphenyl)-pentanoic acid were milled together with 291.5 g of magnesium hydroxide. 30 g of this mixture were stirred into 70 g of a 4% strength aqueous polyvinyl acetate solution (prepared from Mowiol ® 8/88). The coarse dispersion was milled in a sand mill as described in Example 1 until the average particle size was 2.5 μm (→dispersion 5).

16 g of dispersion 4, 5 g of dispersion 5, 4 g of dispersion 3 (from Example 3), 10 g of a 30% strength aqueous calcium carbonate dispersion (average particle size less than 3 μm) and 4 g of a 10% strength aqueous polyvinyl acetate solution (M 05/20—Wacker Chemie) were mixed together, the pH of the mixture was brought to 9, and coating and smoothing were then carried out as described in Example 3.

The measured results obtained in the evaluation of the paper thus coated are listed in Table 3.

TABLE 1

| Example No. | Optical density | Grease resistance | Plasticiser resistance | Whiteness without exposure to oil | Whiteness with exposure to oil | Storage stability after 1 hour | Storage stability after 24 hours at 60° C. |
|---|---|---|---|---|---|---|---|
| 3 (comp) | 1.32 | 18.8% | 12.0% | 82.2% | 86.3% | 4.3% | 4.3% |
| 4 | 1.30 | 82.1% | 67.4% | 88.3% | 81.7% | 10.4% | 9.2% |
| 6 (comp) | 1.28 | 92.5% | 49.0% | 79.3% | 65.4% | 35.1% | 52.9% |
| 7 (comp) | 1.24 | 91.4% | 86.0% | 82.9% | 62.3% | 59.0% | 74.1% |
| 8 (comp) | 1.30 | 79.7% | 21.3% | 85.2% | 81.9% | 20.2% | 71.1% |

Whiteness: the higher the percentage given the whiter the paper
Storage stability; the higher the percentage given the higher the degree of undesirable greying The measured results are listed in Table 1.

EXAMPLES 9 to 17

Production of further recording materials according to the invention

They were prepared analogously to Example 4, except that the mixtures of bis-(4-hydroxyaryl)-alkanoic acid and basic compounds listed in Table 3 were used in the molar ratios given.

TABLE 2

| Example No. | Optical density | Grease resistance | Plasticiser resistance | Sensitivity at 100 μ sec heating period | Sensitivity at 260 μ sec heating period | Sensitivity at 480* μ sec heating period |
|---|---|---|---|---|---|---|
| 3 (comp) | 1.32 | 18.8% | 12.0% | 0.05 | 0.71 | 1.31 |
| 4 | 1.30 | 82.1% | 67.4% | 0.04 | 0.70 | 1.29 |
| 5 (comp) | 1.11 | 35.8% | 19.4% | 0.03 | 0.32 | 0.81 |

*see measuring method e.

TABLE 3

| Example No. | Modified bisphenol carboxylic acid of the formula (I) (1) $R^1$ | $R^2$ | $R^3$ | m | n | Basic compound (2) | Molar ratio (1):(2) | Grease resistance | Plasticiser resistance | Storage stability 24 h/60° C. |
|---|---|---|---|---|---|---|---|---|---|---|
| 9 | H | $CH_3$ | $(CH_2)_2$ | 1 | 0 | $Mg(OH)_2$ | 4:1 | 86.4% | 63.4% | 15.6% |
| 10 | H | $CH_3$ | $(CH_2)_2$ | 1 | 0 | $Mg(OH)_2$ | 4:3 | 81.4% | 62.6% | 13.2% |
| 11 | H | $CH_3$ | $(CH_2)_2$ | 1 | 0 | $Mg(OH)_2$ | 1:1 | 91.1% | 70.8% | 12.0% |
| 12 | H | $CH_3$ | $(CH_2)_2$ | 1 | 0 | $Mg(OH)_2$ | 2:3 | 71.9% | 63.2% | 7.8% |
| 13 | H | $CH_3$ | $(CH_2)_2$ | 1 | 0 | $Mg(OH)_2$ | 1:5 | 70.9% | 55.3% | 9.5% |
| 14 | H | H | B** | 1 | 0 | ZnO | 2:1 | 89.6% | 37.4% | 5.8% |
| 15 | H | $CH_3$ | $(CH_2)_2$ | 1 | 0 | $Ca(OH)_2$ | 2:1 | 85.1% | 58.6% | 2.5% |
| 16 | o-$CH_3$* | $CH_3$ | $(CH_2)_3$ | 1 | 1 | $Mg(OH)_2$ | 2:1 | 92.8% | 77.9% | 27.0% |
| 17 | H | $CH_3$ | $(CH_2)_2$ | 1 | 0 | $MgCO_3$ | 2:1 | 83.8% | 54.3% | 20.4% |
| 18 | H | $CH_3$ | $(CH_2)_2$ | 1 | 0 | $Mg(OH)_2$ | 1:5 | 97.4% | 59.8% | 19.3% |

*Relative to OH
**B denotes a direct bond

The measured results obtained in the evaluation of the paper thus coated are listed in Table 3.

EXAMPLE 18

Production of a recording material according to the invention using 2,2-bis-(4-hydroxyphenyl)-propane as developer 10 g of polyvinyl acetate (U 03/140 type from Wacker Chemie) were dissolved in 635 g of water. 50 g

What is claimed is:

1. A thermoreactive recording material comprising a base material coated with a mixture containing, a) at least one modified bisphenol carboxylic acid of the formula (I)

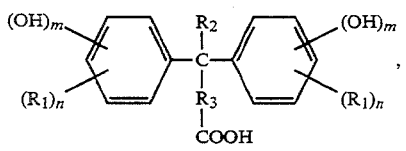

(I)

in which each $R_1$, independently of the others, represents $C_1$- to $C_5$-alkoxy, $C_1$- to $C_6$-alkyl, $C_3$- to $C_6$-cycloalkyl or phenyl, $R_2$ represents hydrogen, $C_1$- to $C_6$-alkyl or phenyl, $R_3$ represents $C_1$-to $C_5$-alkylene or a direct bond, each m, independently of the other, represents one or two, and each n, independently of the other, represents zero, one or two b) and at least one basic compound and c) 5 to 30% by weight of a color developer.

2. A thermoreactive recording material of claim 1, in which in formula (I)

each $R_1$, independently of the others, represents ethoxy, methoxy, i-propoxy, butoxy, pentoxy, methyl, ethyl, propyl, butyl, i-propyl, pentyl, cyclopropyl, cyclobutyl, cyclopentyl, cyclohexyl or phenyl, $R_2$ represents hydrogen, methyl, ethyl, propyl, butyl, 2-propyl, 1-pentyl, 2-pentyl, 1-hexyl, i-butyl or phenyl, $R_3$ represents methylene, 1,1-ethylene, 1,2-ethylene, 1,1-propylene, 1,2-propylene, 1,3-propylene, 2,2-propylene, 1,1-butylene, 1,2-butylene, 1,3-butylene, 1,4-butylene, 2,2-butylene, 2,3-butylene or a direct bond.

3. A thermoreactive recording material of claim 1, in which the basic compound is at least one of hydroxides, oxides and carbonates of magnesium, zinc, calcium, aluminium, lead, boron or titanium.

4. A thermoreactive recording material of claim 1, which contains a mixture of a modified bisphenol carboxylic acid of the formula (I) of symmetrical structure and at least one of oxides, hydroxides and carbonates of $Mg^{2+}$, $Zn^{2+}$, or $Ca^{2+}$.

5. A thermoreactive recording material of claim 1, in which the molar ratio of modified bisphenol carboxylic acid of the formula (I) to basic compound is 0.05 to 5:1.

6. A thermoreactive recording material of claim 1, which further contains at least one triphenylmethane, fluoran, phenothiadiazine, auramine, spiropyran and indolinophthalide leucodyestuff, at least one electron acceptor selected from the group consisting of polyphenols, hydroxydiphenyl sulphones, hydroxydiphenyl sulphoxides, hydroxybenzoic esters, esters of bile acid, hydroxydiphenyl sulphides, hydroxydiphenyl disulphides, salicylic acid and esters and amides thereof, hydroxynaphthalenic acid and esters and amides thereof, bis-(hydroxyphenyl-thio)-dioxa-alkanes, bis-hydroxyphenyl-thio)-oxaalkanes, bis-(hydroxyphenyl)-alkanes and bis-(hydroxyphenyl)-alkanoic esters.

7. A thermoreactive recording material of claim 1, which further contains at least one sensitiser having a melting point in the range from 70° to 140° C.

8. A thermoreactive recording material of claim 1, which further comprises a binder.

9. A thermoreactive recording material of claim 1, which further comprises at least one of fillers, surface-active agents, antioxidants and antifoams.

10. A thermoreactive recording material of claim 1, which further contains as base material a paper having a basis weight of 20 to 200 g/m$^2$, a paperboard or a cardboard.

11. A thermoreactive recording material of claim 1, which further contains, not counting the weight of the base material, 0.1 to 40% by weight of the mixture of modified bisphenol carboxylic acids of the formula (I) and basic compounds, 1 to 20% by weight of colour former, 0 to 30% by weight of colour developer, 0 to 30% by weight of sensitisers and 5 to 80% by weight of binders and other additives, the sum of these components adding up to 100% by weight.

* * * * *